US008701556B2

(12) United States Patent
Shih

(10) Patent No.: US 8,701,556 B2
(45) Date of Patent: Apr. 22, 2014

(54) HANDHELD STAMP ASSEMBLY

(75) Inventor: Hsu-Shen Shih, Tainan (TW)

(73) Assignee: Sun Same Enterprises Co., Ltd., Tainan (TW)

( * ) Notice: Subject to any disclaimer, the term of this patent is extended or adjusted under 35 U.S.C. 154(b) by 831 days.

(21) Appl. No.: 12/550,341

(22) Filed: Aug. 28, 2009

(65) Prior Publication Data

US 2011/0048258 A1 Mar. 3, 2011

(51) Int. Cl.
*B41K 1/42* (2006.01)
*B41K 1/56* (2006.01)

(52) U.S. Cl.
USPC ..... 101/405; 101/333

(58) Field of Classification Search
USPC ..... 101/227, 333, 405, 406
IPC ..... B41K 1/42
See application file for complete search history.

(56) References Cited

U.S. PATENT DOCUMENTS

| | | | | |
|---|---|---|---|---|
| 2,047,373 | A | 7/1936 | Kingsley | |
| 2,872,861 | A | 2/1959 | Smith et al. | |
| 3,302,566 | A | 2/1967 | Blanchet | |
| 3,388,662 | A | 6/1968 | Ravreby | |
| 5,048,415 | A | 9/1991 | Shih | |
| 5,438,929 | A * | 8/1995 | Wong et al. | 101/405 |
| 6,047,639 | A | 4/2000 | Shih | |
| 6,360,661 | B1 * | 3/2002 | Cheung | 101/333 |
| 7,073,437 | B2 | 7/2006 | Petersen | |
| 8,141,486 | B2 * | 3/2012 | Faber | 101/333 |

FOREIGN PATENT DOCUMENTS

| | | | |
|---|---|---|---|
| CN | 2547513 | Y | 4/2003 |
| EP | 2319702 | A1 | 5/2011 |
| FR | 2447785 | A1 | 8/1980 |
| GB | 2197821 | | 6/1988 |
| GB | 2197821 | A | 6/1988 |
| JP | 2000108476 | A | 4/2000 |
| JP | 3093113 | U | 4/2003 |
| KR | 200272313 | Y1 | 4/2002 |
| RU | 13777 | U1 | 5/2000 |
| WO | 8806977 | A1 | 9/1988 |

OTHER PUBLICATIONS

Partial European Search Report (May 3, 2010).
Extended European Search Report (Sep. 1, 2010).
European Search Report, Sep. 1, 2010.
Notice of Preliminary Rejection From Korean Intellectual Property Office, Dec. 14, 2011.
Substantive Examination Adverse Report From Intellectual Property Corparation of Malaysia, Aug. 15, 2012.
Subsequent to the Results of Substantial Examination Office Action From Rospatent, Jul. 14, 2011.

* cited by examiner

*Primary Examiner* — Ren Yan
*Assistant Examiner* — Marissa Ferguson Samreth
(74) *Attorney, Agent, or Firm* — SU IP Consulting

(57) ABSTRACT

One embodiment of the present invention sets forth a handheld stamp assembly. The handheld stamp assembly includes a stamp mount having a top member with an opening and a bottom member capable of being slid into the top member along a first direction through the opening, wherein the top member and the bottom member form an enclosure when the top member slides into and is secured with the bottom member; and a handle coupled to the stamp mount in a detachable manner along a second direction.

17 Claims, 7 Drawing Sheets

200

300

500

HANDHELD STAMP ASSEMBLY

BACKGROUND OF THE INVENTION

1. Field of the Invention

The present invention generally relates to a handheld stamp.

2. Description of the Related Art

Unless otherwise indicated herein, the approaches described in this section are not prior art to the claims in this application and are not admitted to be prior art by inclusion in this section.

Handheld stamps have long been used as marking tools. FIG. 1 is a schematic drawing of a typical handheld stamp 100. A handheld stamp 100 comprises a handle 102, a stamp mount 104, and a bottom cover 106. The handle 102 is disposed on and extends out of the top of the stamp mount 104. The bottom cover 106 is removably attached to the bottom of the stamp mount 104. A die face 108 is attached to the bottom of the stamp mount 104 and is configured to be covered by the bottom cover 106.

To use the handheld stamp 100, the bottom cover 106 is detached from the bottom of the stamp mount 104. A user may hold the handle 102 and apply pressure downward onto the stamp mount 104, so that the die face 108 is pressed against a surface to leave an image or pattern on the surface. When the handheld stamp 100 is not in use, the bottom cover 106 may be coupled to the stamp mount 104 to prevent the die face 108 from possibly staining the surroundings of the handheld stamp 100.

The typical handheld stamp 100 is associated with a single image or pattern. To stamp a different image or pattern, another handheld stamp may be required. In other words, if multiple images or patterns are desired, then multiple handheld stamps with each stamp engraved with a unique image or pattern may be required. Having multiple handheld stamps not only increases cost but also makes storage burdensome.

What is needed in the art is thus a cost effective way to manufacture the handheld stamp and address at least the problems set forth above.

SUMMARY OF THE INVENTION

One embodiment of the present invention sets forth a handheld stamp assembly. The handheld stamp assembly includes a stamp mount having a top member with an opening and a bottom member capable of being slid into the top member along a first direction through the opening, wherein the top member and the bottom member form an enclosure when the bottom member slides into and is secured with the top member, a handle coupled to the stamp mount in a detachable manner along a second direction.

Another embodiment of the present invention sets forth another handheld stamp assembly. The handheld stamp assembly includes a handle having a cavity with an open end and a close end and a stamp mount configured to be coupled to the handle. The stamp mount comprises a substantially circular opening and a substantially rectangular opening, wherein the substantially circular opening is disposed at a first surface of the stamp mount for receiving the handle, and defines a protrusion disposed within the substantially circular opening for locking with the cavity.

Yet another embodiment of the present invention sets forth another handheld stamp assembly. The handheld stamp assembly includes a handle and a stamp mount having a top member and a bottom member. The top member is detachably coupled to the handle and is slidably engaged with the bottom member to form an enclosed space, and the bottom member comprises a first surface to be attached to a die face and a second surface having an ink reservoir with a hole.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
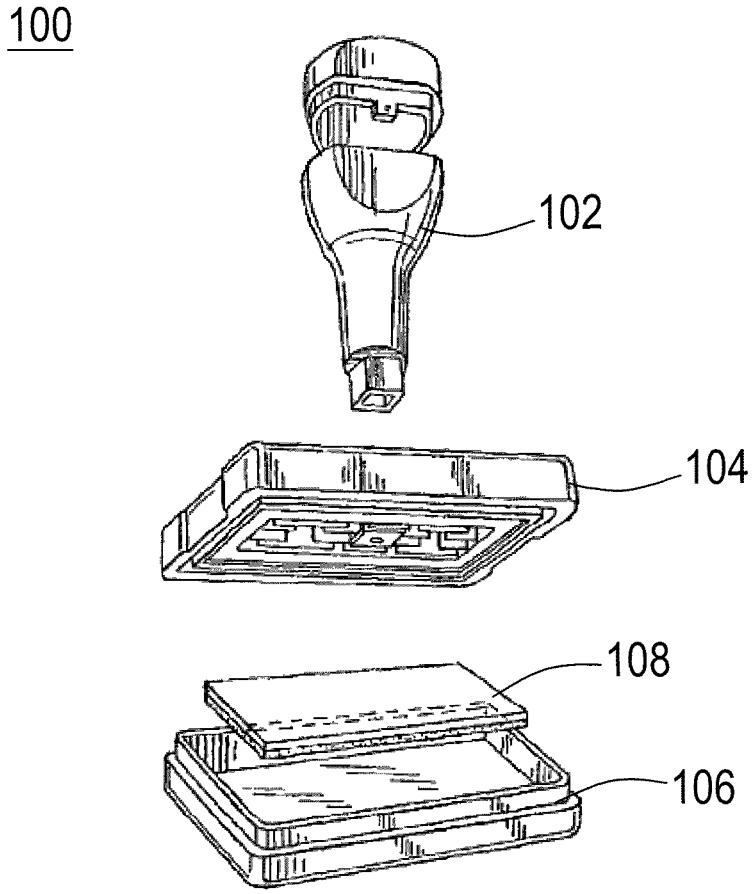
FIG. 1 (PRIOR ART)
FIG. 1 is a schematic drawing of a prior art handheld stamp.
Figure 2A:
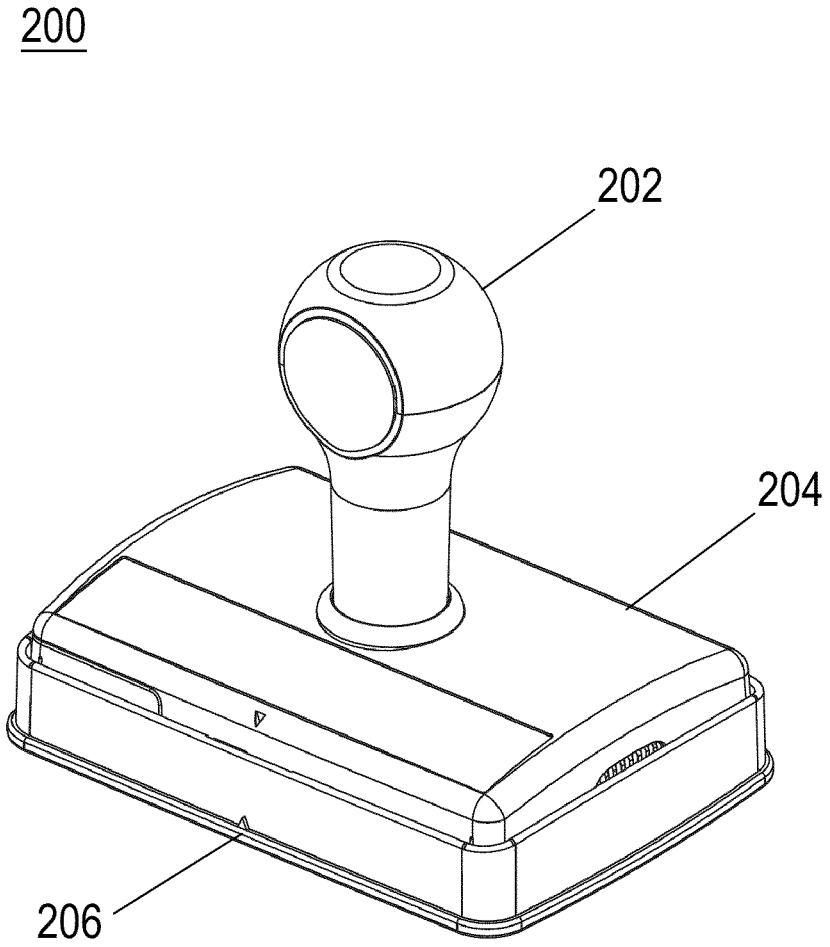
FIG. 2A is a schematic drawing of a handheld stamp according to one embodiment of the present invention.

FIG. 2A is a schematic drawing of a handheld stamp 200 according to one embodiment of the present invention. The handheld stamp 200 comprises a handle 202, a stamp mount 204, and a bottom cover 206. The handle 202 is designed to be grasped by a user. The handle 202 is coupled to the stamp mount 204 via a locking mechanism 208 (shown in FIG. 2B). The locking mechanism 208 will be discussed in detail in the subsequent paragraphs. Although the stamp mount 204 is illustrated to be rectangular, the stamp mount 204 can be in many other geometric shapes. Some example geometric shapes include, without limitation, square, circular, and elliptical. In addition, the geometric shape of the bottom cover 206 may also vary to complement the stamp mount 204. The locking mechanism 208 enables the handle 202 to be flexibly attached to or detached from the stamp mount 204. In other words, the handle 202 may be used with different stamp mounts.

Figure 2B:
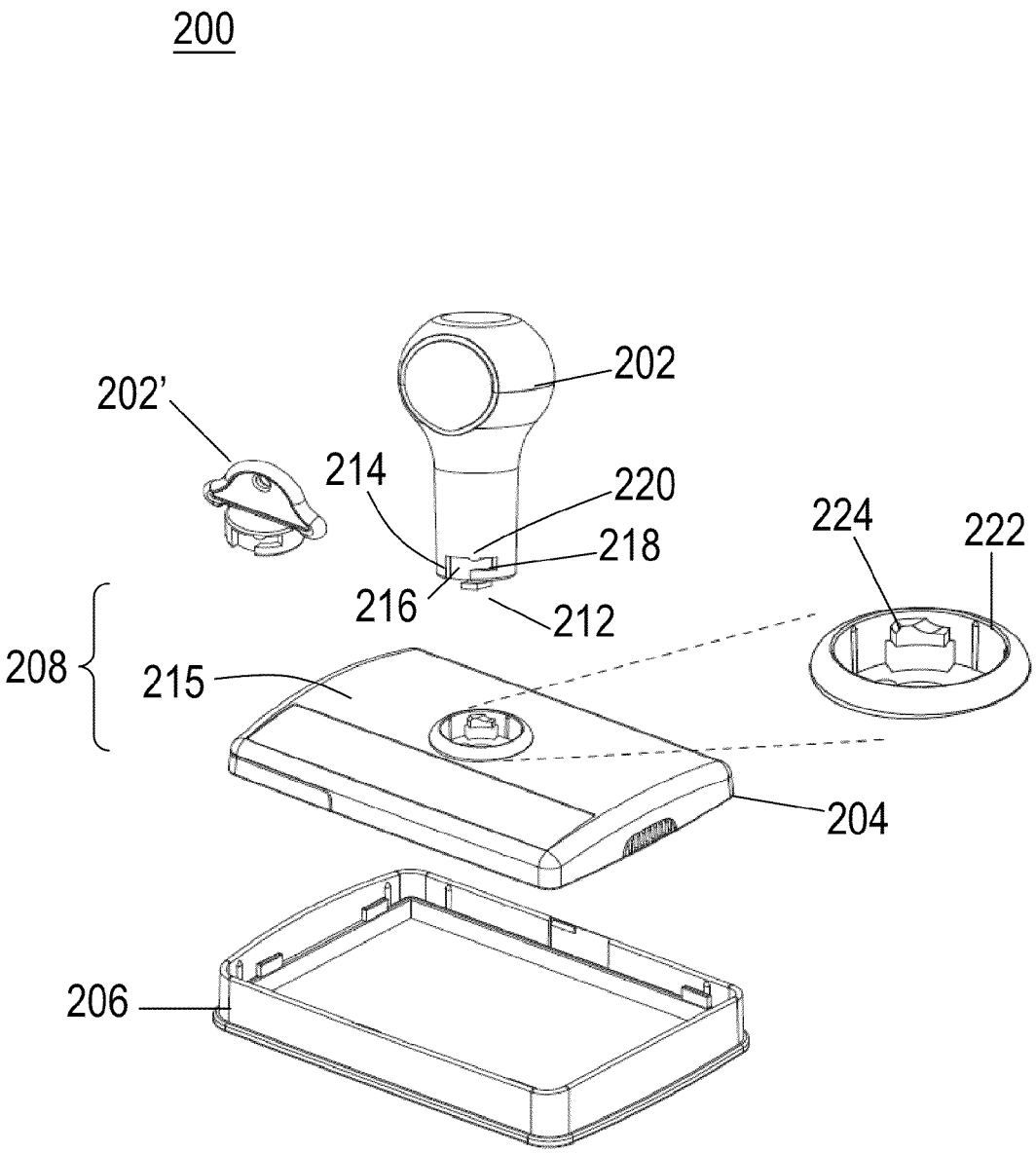
FIG. 2B is an exploded perspective view of the handheld stamp as depicted in FIG. 2A according to one embodiment of the present invention.

In conjunction with FIG. 2A, FIG. 2B is an exploded perspective view of the handheld stamp 200 as depicted in FIG. 2A according to one embodiment of the present invention. The handle 200 comprises a substantially "L" shaped cavity 214. The substantially "L" shaped cavity 214 comprises an open end 216, a close end 218, and a projection 220. The handle 202 is configured to couple to a substantially circular opening 222 at the top surface 215 of the stamp mount 204. At the bottom of the handle 202 is a substantially rectangular shape knob 212 configured to couple to a substantially rectangular receiving opening 309 (shown in FIG. 3B) disposed within the substantially circular opening 222. One side of the substantial rectangular shape knob 212 or the substantial rectangular receiving opening 309 may be curved.

The substantially circular opening 222 further comprises a protrusion 224 at the inner side of the substantially circular opening 222. In some implementations, for ease of portability, the geometric shape of the handle 202 may vary. For example, the shape of an illustrated handle 202' differs from the handle 202. However, like the handle 202, the handle 202' may also include the substantially "L" shaped cavity 214, the open end 216, the close end 218, the projection 220, and the substantial rectangular shape knob 212 (not explicitly shown in FIG. 2B).

As mentioned above, the locking mechanism 208 is configured to secure the handle 202 onto the stamp mount 204. First, the handle 202 is inserted into the substantially circular opening 222 by aligning the substantially rectangular shape knob 212 at the bottom of the handle 202 to the substantially rectangular receiving opening 309 within the substantially circular opening 222. In addition, the open end 216 of the substantially "L" shaped cavity 214 is also aligned to the protrusion 224 for the insertion. Then, the handle 202 is rotated so that the protrusion 224 moves from the open end 216 to the close end 218 of the substantially "L" shaped cavity 214. When the protrusion 224 engages with the projection 220, the protrusion 224 and the projection 220 may be joined together to form a hook and a lock because of the shape designs of the protrusion 224 and the projection 220, therefore securely coupling the handle 202 with the stamp mount 204.

Figure 3A:
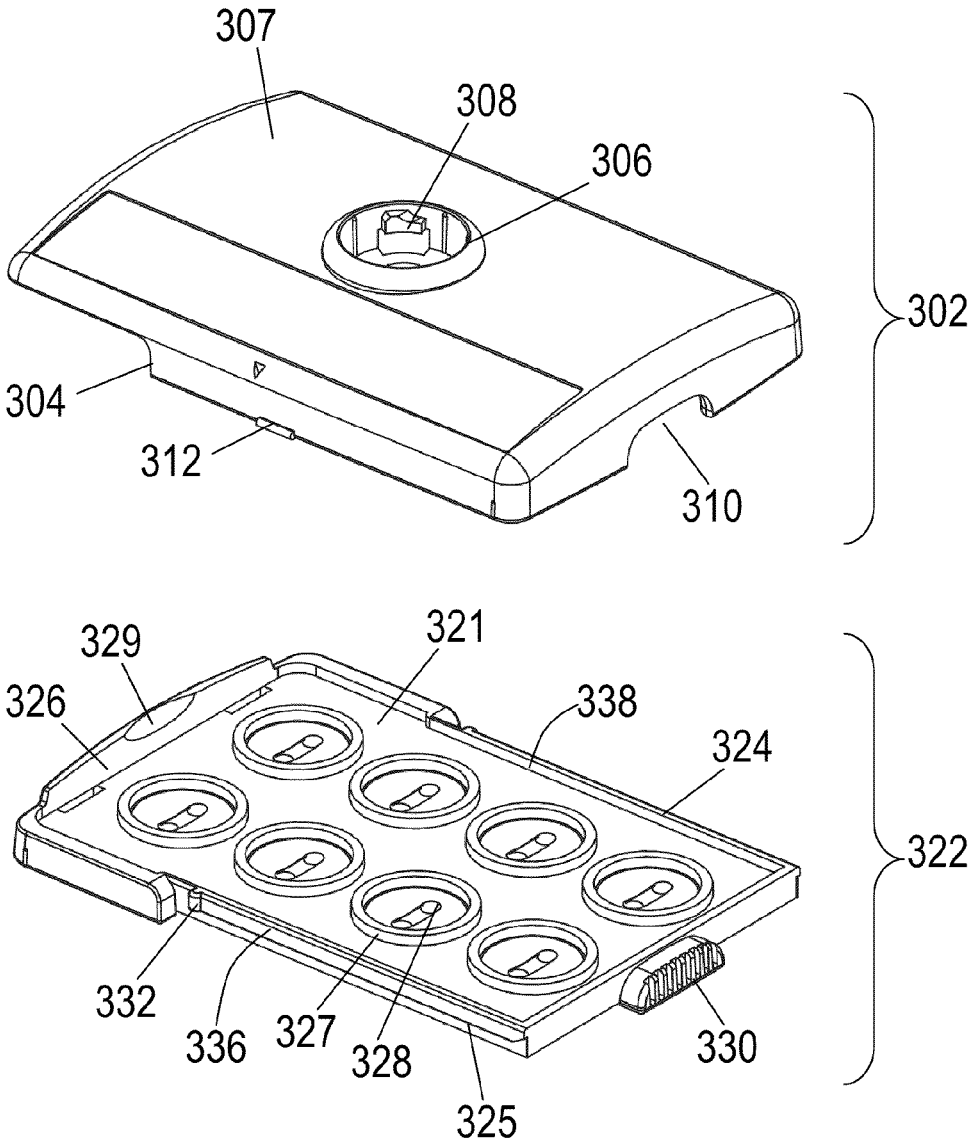
FIG. 3A is an exploded perspective view of a stamp mount of the handheld stamp as depicted in FIG. 2A according to one embodiment of the present invention.
Figure 3B:
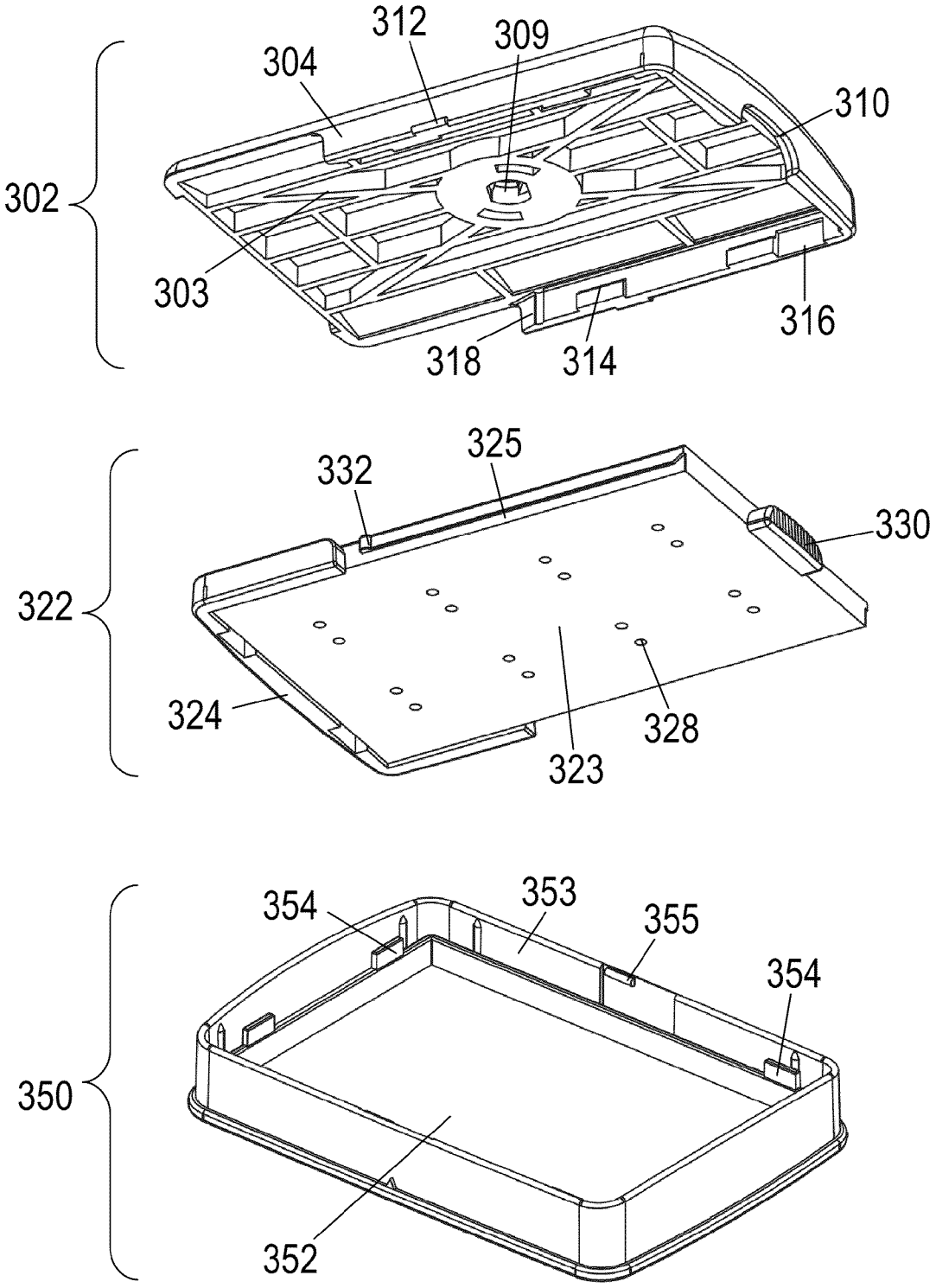
FIG. 3B is another exploded perspective view of the stamp mount and a bottom cover according to another embodiment of the present invention.

According to one embodiment of the present invention, FIG. 3A is an exploded perspective view of a stamp mount 300 of the handheld stamp as depicted in FIG. 2A, and FIG. 3B is another exploded perspective view of the stamp mount 300 and a bottom cover 350. The stamp mount 300 comprises a top member 302 and a bottom member 322. The top member 302 has a side wall 304. The bottom member 322 is slidably engaged with the top member 302 to form an enclosed space. In one implementation, the sidewall 304 may be cut at an angle to form an enlarged entrance for the bottom member 322 to slide into the top member 302. A top surface 307 of the top member 302 includes a substantially circular opening 306 with a protrusion 308, and the top member 302 also includes a substantially rectangular receiving opening 309, which is located within the substantially circular opening 306. This substantially circular opening 306, as discussed above, is configured to receive the handle 202. Support ribs 303 formed on the inner surface of the top member 302 provide structural support to the top member 302. The top member 302 further comprises ribs 312, position blocks 314, a clip open 316, and a bulge 318. The ribs 312 are formed on the outer surface of the sidewall 304. The position blocks 314 provide a sliding track for the bottom member 322. The bulge 318 is in connection with the bottom member 322 and is configured to provide stabilization between the bottom member 322 and the top member 302. The clip open 316 provides alignment for the stamp mount 300 to engage with the bottom cover 350. The subsequent paragraphs will further explain the mechanism to engage with the bottom cover 350.

The bottom member 322 comprises a top surface 321 and a bottom surface 323. The bottom surface 323 may be configured to be attached to a die face (not shown). The top surface 321 further comprises an ink reservoir 327 and a hole 328 for the ink reservoir 327 for the ink to flow through to the die face, if one is attached to the bottom surface 323. The bottom member 322 further comprises a ledge 324 formed around the top surface 321. One end of the ledge 324 is a door 326 with a groove 329. On another end of the ledge 324 is a pushing block 330. The door 326, the groove 329, and the pushing block 330 allow the bottom member 322 to be pulled, pushed, and/or detached from the top member 302. The pushing block 330 is further configured to be inserted into an aligning slot 310 on one side wall of the top member 302 to ensure proper alignment of the bottom member 322 to the top member 302. Sliding tracks 325 are formed on opposite sidewalls 336 and 338 of the bottom member 322. The sliding tracks 325 are configured to be aligned with the position blocks 314. A protrusion 332 is placed on one end of the sliding tracks 325. When the bottom member 322 slidably engages with the top member 302, and the protrusion 332 engages with the block 318, the bottom member 322 is securely coupled to the top member 302.

The bottom cover 350 comprises a bottom 352, a sidewall 353, multiple alignment retainers 354, and ribs 355. The bottom 352 has an inner top surface and an outer edge. In one implementation, the inner top surface of the bottom 352 of the bottom cover 350 may further comprise an ink pad for a die face that may be attached to the bottom member 322. The sidewall 353 is formed on and extends up from the outer edge and the inner top surface of the bottom 352. The alignment retainers 354 are formed on and extend up from the inner surface of the bottom 352 near the sidewall 353. The ribs 355 are formed on the inner surface of the sidewall 353 and are in alignment with one another and transversely off-center. With further reference to FIG. 3B, the ribs 355 selectively align and engage with the ribs 312 on the outer surface of the sidewall 304 of the top member 302. One or more of the alignment retainers 354 may also align and engage with the clip open 316.

With further reference to FIG. 2B, when the handheld stamp is in use, with the stamp mount 300 oriented substantial 180 degrees relative to the bottom cover 350, the bottom cover 350 may be used as a cover for the stamp mount 300 so that the die face with ink may not stain the surface that it comes in contact with.

Figure 4:
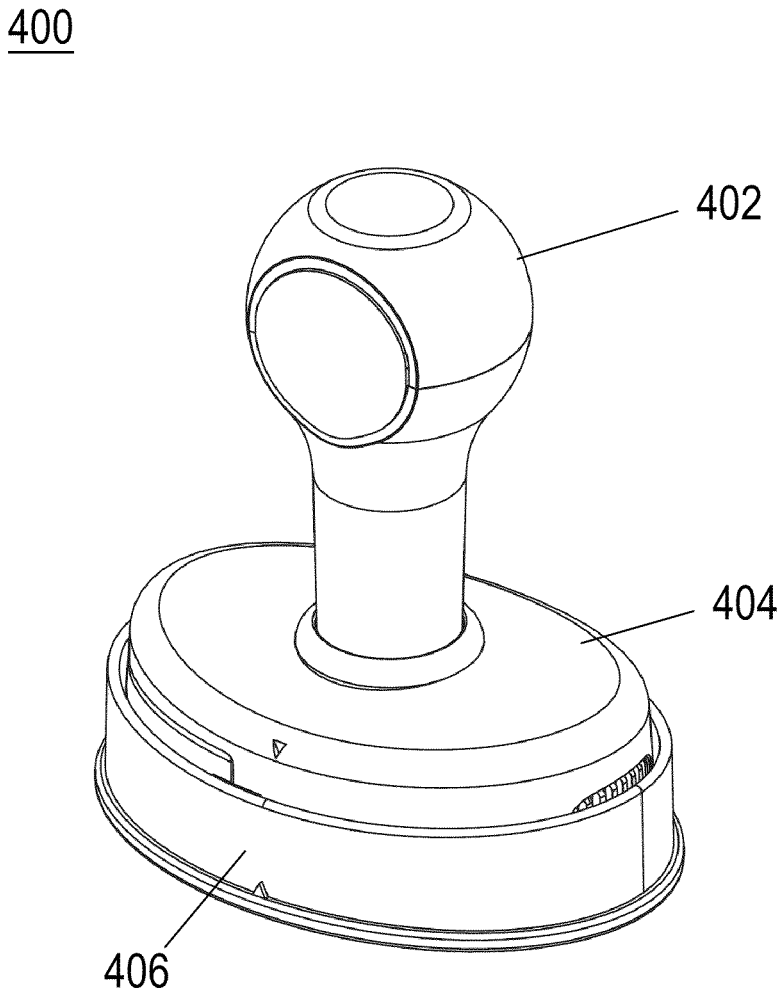
FIG. 4 is a schematic drawing of another embodiment of a substantially circular shaped handheld stamp according to the present invention.

FIG. 4 is a schematic drawing of a substantially circular shaped handheld stamp 400 according to another embodiment of the present invention. The substantially circular shaped handheld stamp 400 comprises a handle 402, a circular shaped stamp mount 404, and a matching bottom cover 406. As discussed previously, the handle 402 may be attached to a stamp mount of varying shapes using the same locking mechanism.

Figure 5:
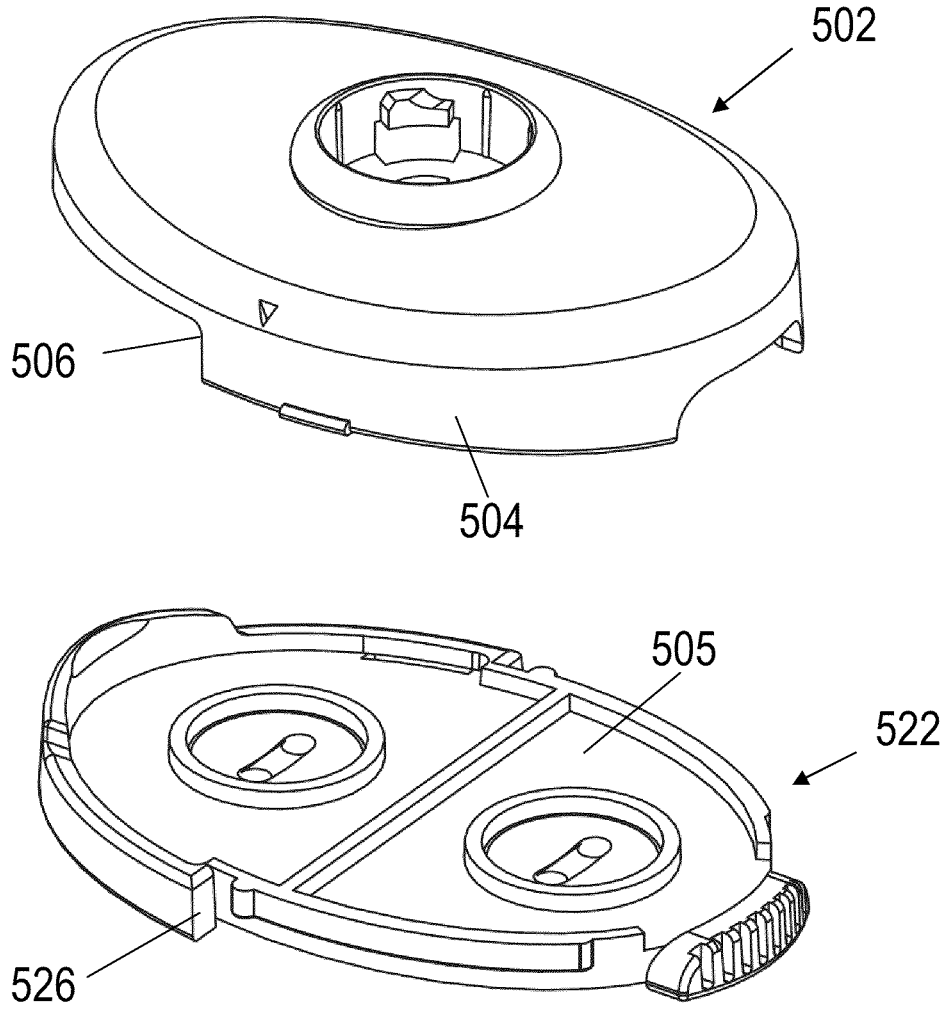
FIG. 5 is an exploded perspective view of a stamp mount of a substantially circular shaped handheld stamp according to one embodiment of the present invention.

FIG. 5 is an exploded perspective view of a circular shaped stamp amount 500 of the circular shaped handheld stamp as depicted in FIG. 4 according to one embodiment of the present invention. The circular shaped 500 comprises the same basic features as shown in FIG. 3A and FIG. 3B, such as a top member 502 with side walls 504 and a bottom member 522. The bottom member 522 is slidably engaged within the inner side of the top member 502 to form an enclosed space 505. The sidewall 504 of the top member 502 is cut at an angle to form an opening 506. The corresponding position for the bottom member 522 is also cut at an angle to form an edge 526 which also fits with the opening 506. The opening 506 provides the bottom member 522 a larger entry space for easier entrance. The edge 526 allows the bottom member 522 to engage with the top member 502 to form a secured substantially circular shaped stamp mount 500.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. A handheld stamp assembly comprising:

a handle having a cavity with an open end and a closed end; and a stamp mount configured to be coupled to the handle, wherein the stamp mount comprises a substantially circular opening and a substantially rectangular opening, wherein the substantially circular opening is disposed at a first surface of the stamp mount for receiving the handle, and defines a protrusion disposed within the substantially circular opening for locking with the cavity, and the handle further comprises a substantially rectangular shape knob at a bottom of the handle to insert into the substantially rectangular opening disposed within the substantially circular opening.

2. The handheld stamp assembly of claim 1, wherein the cavity is a substantially "L" shaped cavity.

3. The handheld stamp assembly of claim 2, wherein the substantially "L" shaped cavity further comprises a projection.

4. The handheld stamp assembly of claim 3, wherein the projection is in contact with the protrusion to form a hook and a lock to secure the handle onto the stamp mount.

5. A handheld stamp assembly comprising:

a handle; and a stamp mount having a top member and a bottom member, wherein the top member is detachably coupled to the handle and is slidably engaged with the bottom member to form an enclosed space, and the bottom member comprises a first surface to be attached to a die face and a second surface having an ink reservoir with a hole, wherein the bottom member further comprises a ledge formed around the bottom member, the ledge having a door disposed on one end of the ledge and a pushing block disposed on an opposite end of the door, and one or more sliding tracks disposed on the sides of the ledge.

6. The handheld stamp assembly of claim 5, wherein the top member further comprises a substantially circular opening disposed at a top surface of the top member for receiving the handle, and a protrusion disposed in the substantially circular opening for engaging the stamp mount with the handle, a sidewall with a first opening and a second opening, and a pair of position blocks configured to define a path.

7. The handheld stamp assembly of claim 6, wherein the top member further comprises a bulge for engaging the top member to the bottom member.

8. The handheld stamp assembly of claim 6, wherein the top member further comprises an aligning slot on one side wall of the top member.

9. The handheld stamp assembly of claim 6, wherein the sidewall of the top member may be cut at a first angle to mate with an edge formed at a second angle at a corresponding position of the bottom member.

10. The handheld stamp assembly of claim 5, wherein the top member further comprises a substantially rectangular receiving opening disposed in the substantially circular opening.

11. The handheld stamp assembly of claim 5, wherein the die face includes an ink absorbent material.

12. The handheld stamp assembly of claim 5, wherein the sliding tracks of the bottom member is configured to be aligned with the position blocks of the top member.

13. A handheld stamp assembly comprising:

a stamp mount having a top member with an opening and a bottom member capable of being slid into the top member along a first direction through the opening, wherein the top member and the bottom member form an enclosure when the bottom member slides into and is secured with the top member, and the bottom member further comprises an ink reservoir disposed on a first surface of the bottom member and a hole through the ink reservoir, a ledge formed around the bottom member, the ledge having a door disposed on one end of the ledge and a pushing block disposed on an opposite end of the door, and sliding tracks disposed on the sides of the ledge; and a handle coupled to the stamp mount in a detachable manner along a second direction, wherein the first direction is substantially perpendicular to the second direction.

14. The handheld stamp assembly of claim 13, wherein the handle further comprises a substantially "L" shaped cavity with an open end and a closed end.

15. The handheld stamp assembly of claim 13, wherein the top member further comprises a substantially circular opening disposed at a surface of the top member for receiving the handle, and a protrusion disposed in the substantially circular opening for engaging the stamp mount with the handle, a sidewall with a first opening and a second opening, and a pair of position blocks configured to define a path.

16. The handheld stamp of claim 13, wherein a die face is configured to be attached to a second surface of the bottom member.

17. The handheld stamp assembly of claim 13, further comprising a bottom cover having a cavity for receiving the stamp mount.

* * * * *